United States Patent [19]

Mintz

[11] Patent Number: 4,524,847

[45] Date of Patent: Jun. 25, 1985

[54] LADDER

[76] Inventor: Daniel Mintz, 70 Cambridge Pl., Brooklyn, N.Y. 11238

[21] Appl. No.: 576,742

[22] Filed: Feb. 3, 1984

[51] Int. Cl.[3] ..... E06C 1/18; E06C 1/32

[52] U.S. Cl. ..... 182/23

[58] Field of Search ..... 182/23, 24, 22, 178

[56] References Cited

U.S. PATENT DOCUMENTS

| | | | |
|---|---|---|---|
| 40,500 | 11/1863 | Philips | 182/23 |
| 66,655 | 7/1867 | Turner | 182/178 |
| 739,309 | 9/1903 | Harmon | 182/23 |
| 1,189,514 | 7/1916 | Wallace | 182/129 |
| 1,428,370 | 9/1922 | Harmon | 182/23 |
| 1,987,535 | 1/1935 | Morris | 182/23 |
| 2,350,129 | 5/1944 | Richards | 182/23 |

FOREIGN PATENT DOCUMENTS

| | | | |
|---|---|---|---|
| 320176 | 2/1970 | Sweden | 182/23 |
| 236020 | 7/1925 | United Kingdom | 182/23 |

*Primary Examiner*—Reinaldo P. Machado
*Attorney, Agent, or Firm*—Steele, Gould & Fried

[57] ABSTRACT

A foldable ladder is disclosed which includes in combination a base section and an extension section. A pair of longitudinally aligned slots are provided in the base section rails near the top to receive therein the ends of a transverse pivot bar. The tops of the base section rails are secured to the pivot bar in a manner to permit pivotal movement of the extension section about the base section. The base section is provided with a pair of upwardly open braces and a pair of laterally spaced straps. By utilizing the braces, the sections can be secured in longitudinal juxtaposed planar alignment. By employing the straps, the sections can be secured in angular, generally A-shaped relationship. Additionally, the extension section can be secured within base section in a storage or low height configuration. In one embodiment, one of the rails of the base section can be equipped with a ground contacting member to facilitate movement of the ladder across a surface.

3 Claims, 8 Drawing Figures

FIG.3
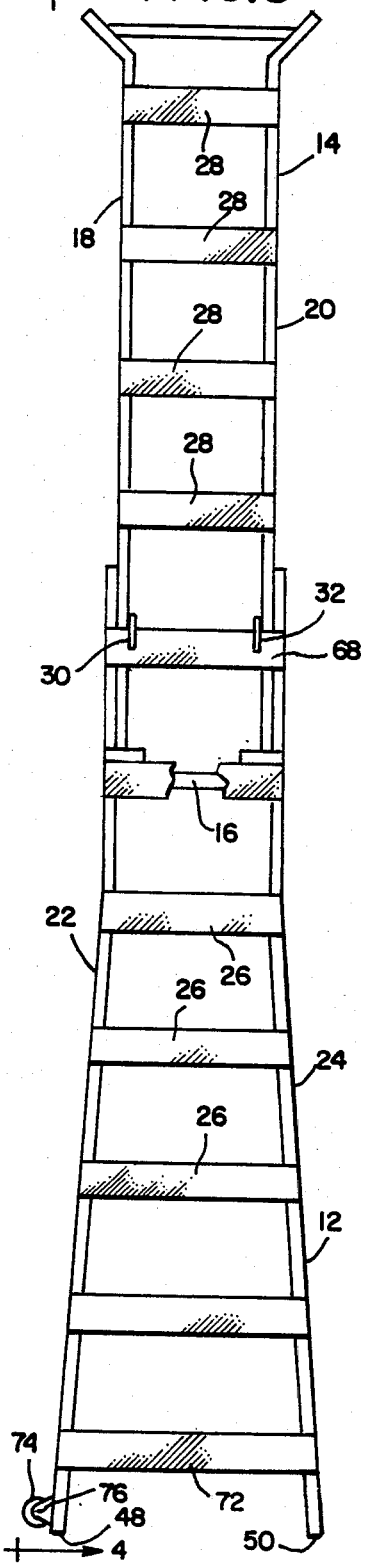
FIG.4
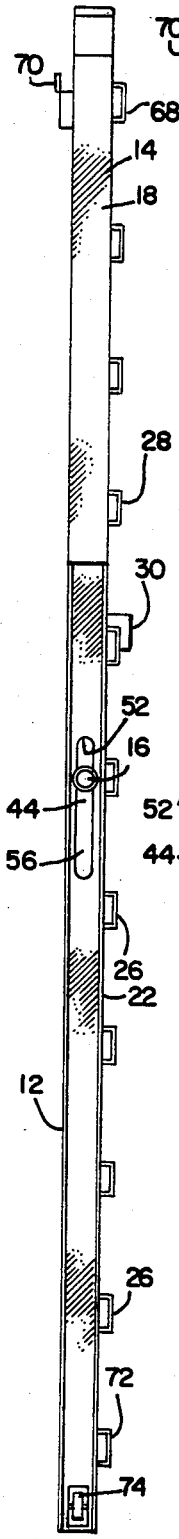
FIG.5
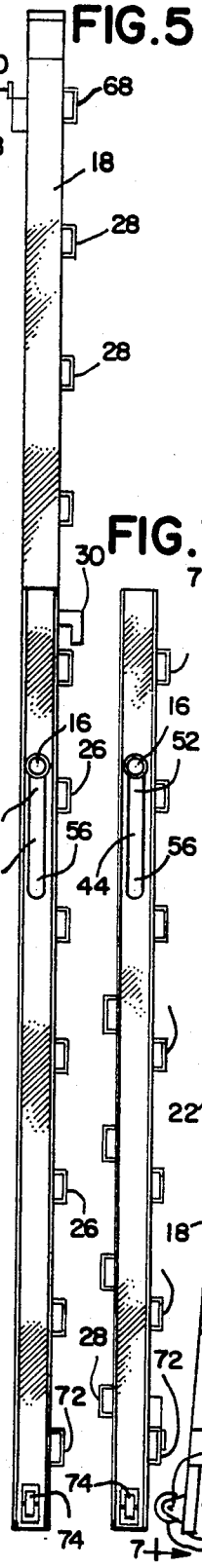
FIG.7
FIG.6
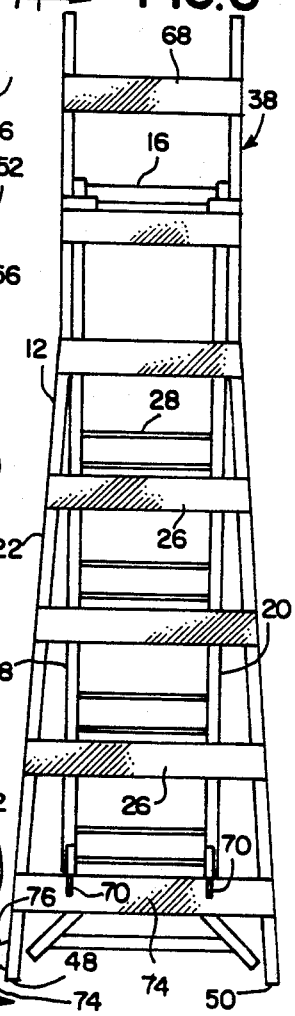

LADDER

FIELD OF INVENTION

This invention relates generally to the field of ladders, and more particularly is directed to a novel universal design which optionally permits either A-shaped, folded arrangement or I-shaped, linear arrangement.

BACKGROUND OF THE INVENTION

Step ladders of various constructions have long been employed to allow workmen and others to reach elevated positions in and about factories, commercial buildings, homes and the like. The usual prior art ladders, of the type contemplated by the present invention, have most frequently been designed in three distinct styles, namely, an A-shaped folding step ladder, an I-shaped straight ladder, or an I-shaped, straight extension ladder. Certain prior designs have permitted two or more I-shaped ladder segments to be joined in end-to-end juxtaposition to create I-shaped combinations of increased length or reach. However, so far as is known to the applicant, there has never been a single design which could permit a single pair of straight ladder sections to optionally be arranged as an A-shaped step ladder, a single section straight ladder, or a double section elongated straight ladder.

SUMMARY OF THE INVENTION

The present invention relates to a universal ladder design which comprises in combination a base section and an extension section, the two sections beng pivotally interconnected by employing a transverse pivot bar. Each section is constructed in a conventional manner with elongated channel-shaped rails and a plurality of interconnecting transverse, spaced rungs. The pivot bar is fixed at the ends of the rails in the extension section and is slidably arranged in elongated slots provided medially in the rails of the base section.

The extension section preferably is equipped with a pair of braces of position and configuration to engage one of the rungs of the base section to secure the sections in linear alignment. In this manner, the overall length of the ladder can be maximized easily by pivoting the extension section about the pivot bar and pulling the pivot bar to the top of its enclosing slots. When the ladder sections are pivoted to linear alignment, the pivot bar can be urged downwardly in the slots until the braces engage and lock upon a rung of the base section. In this position, a stable, sturdy interconnection between the ladder sections can be assured by two longitudinally spaced ladder section connecting parts, namely, the pivot bar which connects the rails of the respective sections and the pair of braces which interconnect the rails of the extension section with a rung of the base section.

In accordance with the teachings of the present invention, the pivotally interconnected base section and extension section can be readily interchanged between any of the three operating positions, namely, a linear extension position, an A-shaped, step ladder position and a linear storage or folded position. Thus, a single ladder configuration can now be employed for a plurality of functions and a single ladder can be purchased and used in lieu of a plurality of separate, specially designed ladders.

It is therefore an object of the present invention to provide an improved ladder construction of the type set forth.

It is another object of the present invention to provide a novel ladder that incorporates a base section, an extension section, means to pivotally interconnect the base section with the extension section and means to secure the ladder section in any of three operating positions.

It is another object of the present invention to provide a novel ladder construction comprising a base section, a pivotally interconnected extension section, brace means to optionally secure the base section to the extension section in linear alignment and strap means to optionally secure the base section to the extension section in angular alignment.

It is another object of the present invention to provide a novel ladder including a base section and a pivotally interconnected extension section and single roller means secured in the base section to facilitate transport of relatively heavy ladder constructions.

It is another object of the present invention to provide a novel ladder that is simple in design, rugged in construction and trouble free when in use.

Other objects and a fuller understanding of the invention will be had by referring to the following description and claims of a preferred embodiment, taken in conjunction with the accompanying drawings wherein like reference characters refer to similar parts throughout the several views and in which:

BRIEF DESCRIPTION OF THE DRAWINGS

FIG. 3 is a front elevational view of the ladder of the present invention with the ladder sections illustrated in their extension position.

FIG. 4 is a side elevational view of the ladder looking from line 4—4 on FIG. 3.

FIG. 5 is a side elevational view similar to FIG. 4, showing the relative positions of the ladder sections prior to securing together.

FIG. 6 is a front elevational view of the ladder of the present invention with the ladder sections illustrated in their storage or folded position.

FIG. 7 is a side elevational view of the ladder looking from line 7—7 on FIG. 6.

DESCRIPTION OF THE PREFERRED EMBODIMENT OF THE INVENTION

Figure 2:
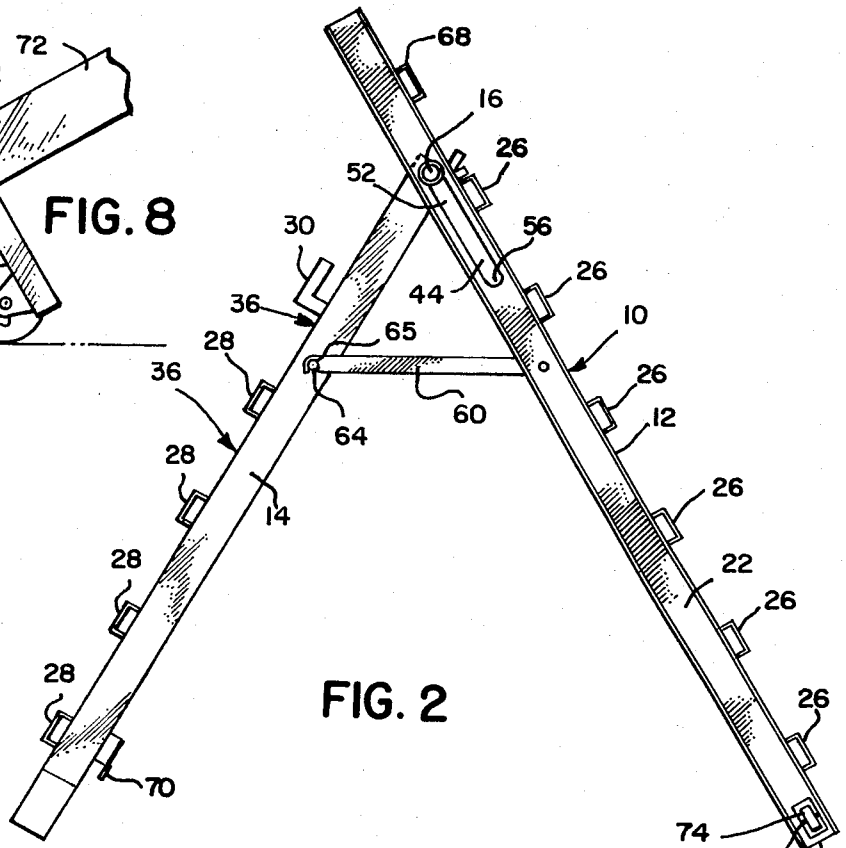
FIG. 2 is a side elevational view of the configuration of FIG. 1.

Although specific terms are used in the following description for the sake of clarity, these terms are intended to refer only to the particular structure of the invention selected for illustration in the drawings, and are not intended to define or limit the scope of the invention.

Figure 1:
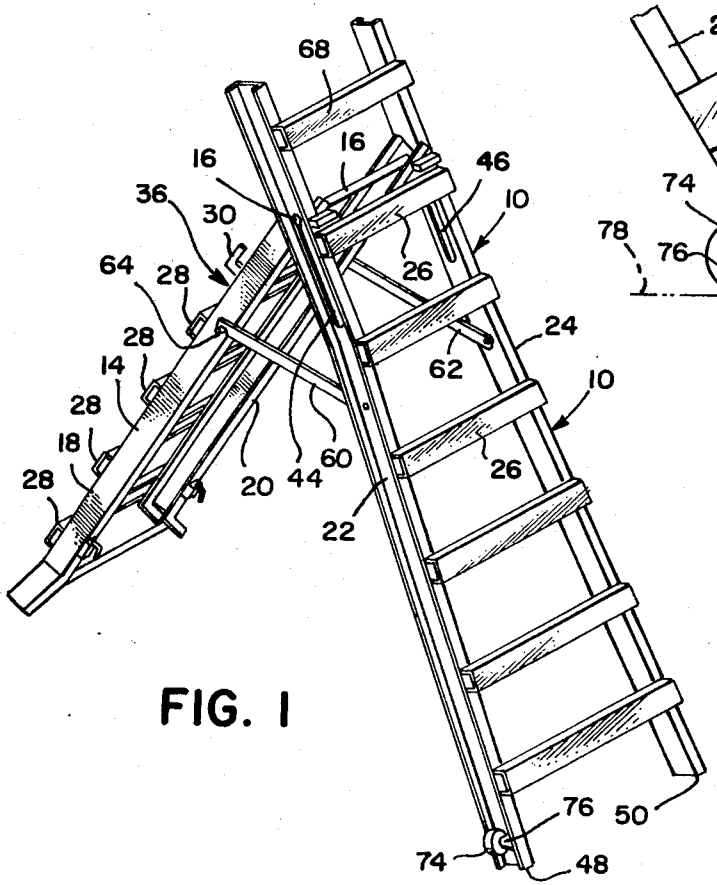
FIG. 1 is a perspective view of the ladder of the present invention with the ladder sections illustrated in their step ladder position.

Referring now to the drawings, there is illustrated in FIGS. 1 and 2 a ladder 10 comprising generally a base section 12 and an extension section 14. The base section and extension section are conventionally formed of usual materials, such as aluminum channels, and are pivotally interconnected about a transverse pivot means for pivotal movement of the extension section 14 relative to the base section 12. In the illustrated embodiment, the pivot means comprises a pivot bar 16 transversely secured in the end portions of the extension section rails 18, 20, which bar is movable within the longitudinal slots 44, 46 provided near the upper ends of the base section rails 22, 24.

The base section 12 and extension section 14 are conventionally formed and preferably are manufactured of usual ladder construction materials, for example, aluminum channels which are welded or riveted to provide an extremely sturdy, light-weight ladder construction. As illustrated, the base section 12 comprises a pair of elongated, transversely spaced rails 22, 24 and a plurality of longitudinally spaced rungs 26. The rails 22, 24 may be medially bent as illustrated to spread the ground contacting feet 48, 50 for stability purposes. The extension section 14 comprises a pair of elongated, transversely spaced rails 18, 20 and a plurality of longitudinally spaced rungs 28. The spacing between the base section rails 22, 24 is sufficient to receive therebetween the rails 18, 20 of the extension section 14 when the parts are pivoted to the storage or folded position 38 as shown in FIGS. 6 and 7. A pair of transversely spaced, L-shaped braces 30, 32 project forwardly from the rails 18, 20 of the extension section 14 for securing the parts together as hereinafter more fully set forth.

Still referring to FIGS. 1 and 2, it will be noted that when the ladder is pivoted to the step ladder position 36 as illustrated, the parts will be oriented to define therebetween an angle of approximately sixty to seventy degrees for stability purposes. The pivot bar 16 will be urged against the upper ends 52 of the elongated slots 44, 46 to facilitate pivotal movement thereabout in known manner. A pair of left and right straps 60, 62 are pivotally secured on the base section rails 22, 24 and are provided with endward slots 64 in well-known manner. The slots 64 of the straps engage pins 65 which are seated in the extension section rails 18, 20, also in well-known manner, to releasably secure the sections 12, 14 in an A-shaped configuration when the ladder 10 is to be used in its step ladder position 36.

In order to use the ladder 10 in its extension position 34 to reach higher locations, as illustrated in FIGS. 3 and 4, the base section 12 and extension section 14 are releasably secured in longitudinal juxtaposition. The sections are first arranged in linear alignment by pivoting the extension section about the pivot bar 16. With the sections so aligned, the extension section 14 is pushed or pulled as necessary in a direction away from the base section 12 until the pivot bar 16, which is affixed to the extension section, stops against the respective upper ends 52 of the longitudinal slots 44, 46. In this orientation, as illustrated in FIG. 5, the downwardly open braces 30, 32 will be spaced above the uppermost rung 68 of the base section 12 by a distance that is less than the length of the longitudinal slots 44, 46. Then, by allowing the extension section 14 to longitudinally move in a direction toward the base section, the pivot bar 16 will approach the lower ends 56 of the slots 44, 46 until the L-shaped brackets or braces 30, 32 bottom upon the uppermost rung 68 of the base section. See FIGS. 4 and 5.

In this latter position, as illustrated in FIGS. 3 and 4, the base section 12 and extension section 14 will be releasably secured in longitudinal planar alignment in two longitudinally spaced locations, namely through the interaction of the ends of the pivot bar 16 and the longitudinal slots 44, 46 and through the interaction of the transversely spaced braces 30, 32 and the uppermost rung 68. So long as the sections 12, 14 are maintained in generally vertical position, as illustrated in FIGS. 3 and 4, there will be no tendency of the sections to separate and the forces of gravity will function to assure a strong, elongated ladder that will not separate under all conditions of normal use.

When it is desired to fold the ladder 10 for storage purposes, or for use when working at lower heights, preferably the ladder is lowered to a horizontal position to remove the downward force vector at the pivotal interconnection between the sections 12, 14. The extension section 14 can then be easily pushed or pulled in a direction away from the base section 12, thereby causing the pivot bar 16 to ride within the slots 44, 46 toward the respective upper slot ends 52. It will be appreciated that as the pivot bar 16 approaches the upper slot ends 52, the brackets or braces 30, 32 will be pulled clear of engagement upon the uppermost base section rung 68. Once the braces 30, 32 disengage from the rung 68, the extension section 14 can then be easily pivoted about the pivot bar 16 into planar alignment with the base section 12. See FIGS. 6 and 7.

In the storage or folded position 38, the rails 22, 24 of the base section will overfit the rails 18, 20 of the extension section 14 and the rungs 26, 68, 72 of the base section 12 will face in a direction opposite to the direction of the rungs 28 of the extension section 14. In the extension position 34 illustrated in FIGS. 3 and 4, the rungs 26, 68, 72 of the base section and the rungs 28 of the extension section will all face in the same direction, thereby providing a uniform climbing arrangement along the entire combined length or height of the longitudinally aligned base and extension sections 12, 14. Preferably, one or more twist locks 70 secure the extension section rails 18, 20 to the lowermost rung 72 of the base section to releasably maintain the sections in the storage or folded position 38.

Figure 8:
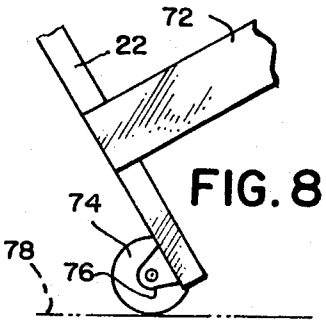
FIG. 8 is an enlarged, partial, side elevational view showing the wheel in contact with the ground for ladder movement purposes.

To facilitate movement of the ladder 10 over the ground surface when the ladder sections are in either the extension position 34 or the folded position 38, a wheel 74 is secured in a stationery manner near the bottom of one of the base section rails 22 or 24. In one embodiment, as shown in FIGS. 3–7, a bracket 76 of known design is secured near the bottom of the base section rail 22 to carry the roller or wheel 74. By angularly cocking or leaning the ladder 10, the roller or wheel 74 can be caused to contact the ground surface 78, as illustrated in FIG. 8, thereby provided a wheel means to move the ladder 10 without requiring lifting.

Although the invention has been described with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specifications, but rather only by scope of the claims appended hereto.

What is claimed is:

1. A ladder for reaching a location above ground level comprising a base section comprising a pair of transversely spaced, channel-shaped first rails, the first rails having longitudinally extending webs and longitudinally extending legs connected to the webs, and a plurality of longitudinally spaced first rungs secured to the first rails at the said longitudinally extending legs thereof, each of the first rails being provided with an elongated opening in an upper portion of each respective web;

an extension section connected to and being pivotally and longitudinally movable with respect to the base section, the extension section comprising a pair of transversely spaced channel-shaped second rails having longitudinal webs and legs and a plurality of longitudinally spaced second rungs secured to the second rails at the longitudinal legs thereof;

pivot means fixably secured to the longitudinal webs of the extension section to pivotally interconnect the base section with the extension section, end portions of the pivot means being positioned within the elongated openings and being adapted for longitudinal movement within the openings, and an L-shaped bracket secured to a second rail and adapted to move when the extension section is moved, the bracket engaging one of the first rungs when the extension section is longitudinally moved, whereby the extension section may be pivoted relative to the base section between angular offset and longitudinally aligned positions.

2. The ladded of claim 1 wherein the pivot means comprises a pivot bar and wherein the elongated openings extend between an upper end and a lower end, the pivot bar being movable within the openings between the upper end and the lower end, the bracket not being in contact with the said first rung when the extension section is pivoted to its longitudinally aligned position and the pivot bar is moved to the upper end of the openings, and a strap pivotally secured to one of the ladder sections and releasably secured to the other ladder section, the strap securing the sections in angular relationship below the pivot means.

3. The ladder of claim 2 wherein the first rungs extend from the legs of the first rails in a first direction when the sections are pivoted into planar alignment and wherein the second rungs extend from the legs of the second rails in a second, opposite direction and wherein the web of the first rails comprises an inner surface, an outer surface and a ground contacting end and a bracket affixed to the outer surface near the said end, the bracket carrying a wheel member, the wheel member contacting the ground when the ladder is angularly positioned relative to the ground to facilitate movement of the ladder.

* * * * *